US005372869A

United States Patent [19]

Drexinger et al.

[11] Patent Number: 5,372,869

[45] Date of Patent: Dec. 13, 1994

[54] DECORATIVE MOULDING

[76] Inventors: James F. Drexinger, 341 Copley Dr., Lancaster, Pa. 17601; Stephen G. Mearig, 424 E. Harnley Rd., Manheim, Pa. 17545

[21] Appl. No.: 91,426

[22] Filed: Jul. 15, 1993

[51] Int. Cl.[5] ..... B37B 1/00; A47G 35/00

[52] U.S. Cl. ..... 428/174; 428/160; 428/423.1; 428/542.2; 428/192; 52/716.1

[58] Field of Search ..... 428/174, 156, 160, 31, 428/33, 358, 397, 67, 83, 122, 192, 212, 423.1, 542.2, 542.8, 9, 8.8; 52/718.1

[56] References Cited

U.S. PATENT DOCUMENTS

| | | | |
|---|---|---|---|
| 3,888,806 | 6/1975 | Kropscoti | 428/425 |
| 4,277,526 | 7/1981 | Jackson | 428/31 |
| 4,413,027 | 11/1983 | Bildl | 428/67 |
| 4,503,115 | 3/1985 | Hemels et al. | 428/281 |
| 4,622,191 | 11/1986 | Takeuchi | 264/134 |

*Primary Examiner*—Donald J. Loney

[57] ABSTRACT

A decorative moulding is provided to form pre-mitered corners. Two moulding pieces are provided each with both edges cut at a 45° angle. One moulding piece is cut with a 45° angle to the right and the other moulding piece is cut with a 45° angle to the left. By matching up the angled ends of the decorative moulding, either an inside pre-mitered corner or an outside pre-mitered corner can be formed.

2 Claims, 1 Drawing Sheet

DECORATIVE MOULDING

BACKGROUND OF THE INVENTION

1. Field of the Invention

The invention is directed to a decorative moulding for forming a mitered corner on either the inside corner or outside corner of a wall structure.

2. Description of the Prior Art

Approximately ten years ago, decorative mouldings similar in structure to those claimed herein were sold in England. The decorative moulding included two moulding pieces each with the angled cuts on both ends of each piece of moulding and with the angled cuts going on one piece to the right of the face and on the other piece to the left of the face. Those structures were made from polystyrene which encountered problems in the marketplace. Polystyrene was not particularly impact resistant, not fire retardant and could be easily damaged. It did not take paint well, particularly solvent paints. The pre-mitered corner pieces were very light because they were made of polystyrene and did not simulate wood very well which is normally used in moulding.

SUMMARY OF THE INVENTION

A decorative moulding is formed using two moulding pieces. Each of the pieces has a decorative face, a back, two sides and two ends. Each end of each piece has a 45° angle pre-mitered cut relative to the plane of the decorative face. The pre-mitered cuts of each piece are in parallel planes. On one moulding piece, both end cuts extend to the right of the decorative face in parallel planes, and in the other moulding piece, both cuts extend to the left of the decorative face in parallel planes. Each side of each moulding piece is in a plane at a 45° angle to the plane of the decorative face. Said side planes converge at a position spaced from the back of the piece. Each moulding piece is made of high density, fire-rated polyurethane.

DESCRIPTION OF THE PREFERRED EMBODIMENT

Figure 2:
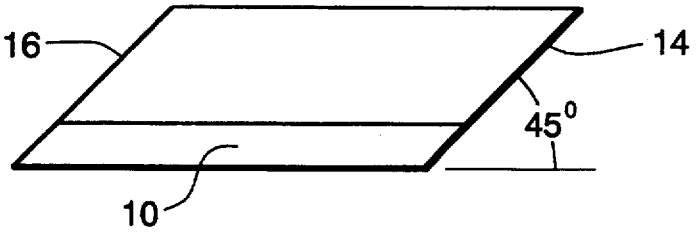
FIG. 2 is a top view of the structure of FIG. 1.
Figure 1:
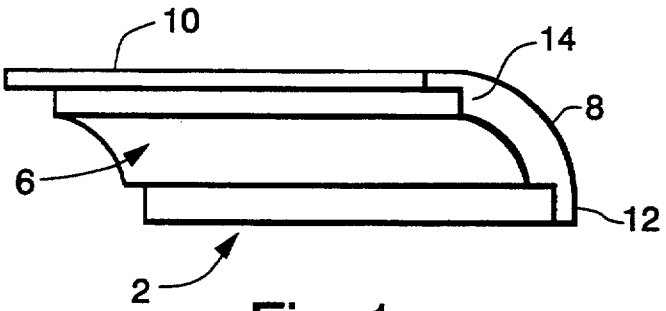
FIG. 1 shows a moulding piece with 45° angle end cuts extending to the right of the front face.
Figure 3:
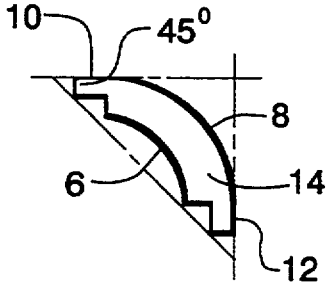
FIG. 3 is an end view of the structure of FIG. 2.
Figure 4:
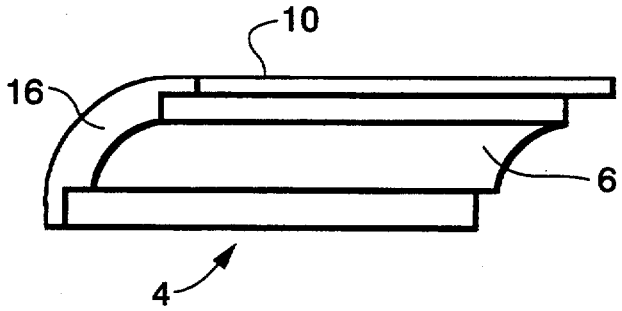
FIG. 4 is a front view of a moulding piece with 45° angle end cuts extending to the left of the decorative face.

The decorative moulding herein is formed of two moulding pieces 2 (FIG. 1) and 4 (FIG. 4). Each of the pieces 2 and 4 have a decorative face 6, a back 8, two sides 10 and 12 and two ends 14 and 16. Each of the ends 14 and 16 of each moulding pieces 2 and 4 are cut at a 45° angle relative the plane of the decorative face. The plane of the decorative face is shown in FIG. 3. The pre-mitered cuts or 45° angle cuts of each end of each piece are in parallel planes as can be seen in the top view of element 2 as shown in FIG. 2. Each side 10 and 12 of each piece are in a plane at a 45° angle to the plane of the decorative face. Said side planes converge at a position spaced from the back of the piece. In FIG. 3, the plane of sides 10 and 12 is shown, and it can be seen that they converge in back of the back 8 of the moulding piece 2. As shown in FIGS. 1 and 4, each of the two moulding pieces 2 and 4 have the end pre-mitered cuts at different 45° angles. In FIG. 1, the 45° angle for the ends 14 and 16 both extend to the right of the decorative face in parallel planes. As shown in FIG. 4, the other moulding piece 4 has both 45° angle end cuts extending to the left of the decorative face in parallel planes.

The moulding pieces are made of high density, fire-rated polyurethane. The polyurethane provides a fire performance that is not available from the polystyrene. It is a more durable structure and its cutability is much improved over that of polystyrene. The polyurethane product is a class B fire rated product which means that the flame spread and smoke generated properties of the moulding herein are superior to that which was previously provided in the marketplace. The polyurethane moulding is more dense and durable and, therefore, is easier to cut and handle. This is particularly true relative the previously used polystyrene moulding. By the use of the pre-mitered corners and the moulding disclosed, product installation can be accomplished by the novice or professional with equal quality. The product is then subsequently painted with water or solvent based paint with equal results.

The product is sold with two moulding pieces which are normally about 12 inch segments, and depending on how the two pieces are put together, it is possible to form an inside or outside corner. Because of the precut miter corners, the consumer or installer does not need to make miter cuts which invariably is difficult for the lay person and time consuming for the installer.

What is claimed is:

1. A decorative moulding comprising:

(a) two moulding pieces, each with a decorative face, a back, two sides and two ends;

(b) each end of each piece having a 45° angle pre-mitered cut relative the plane of the decorative face, said pre-mitered cuts of each piece being in parallel planes;

(c) each side of each piece being in a plane at a 45° angle to the plane of the decorative face, said side planes converging at a position spaced from the back of the piece; and (d) said two moulding pieces being made of fire rated polyurethane.

2. The decorative moulding of claim 1 wherein:

(a) each of the two moulding pieces having the pre-mitered cuts at a different 45° angle with one piece having both cuts extending to the right of the decorative face in parallel planes and the other piece having both cuts extending to the left of the decorative face in parallel planes.

* * * * *